US005232358A

United States Patent [19]

Maruko

[11] Patent Number: 5,232,358

[45] Date of Patent: Aug. 3, 1993

[54] COMBUSTION APPARATUS

[75] Inventor: Saburo Maruko, Yamato, Japan

[73] Assignee: Nippon Chemical Plant Consultant Co., Ltd., Tokyo, Japan

[21] Appl. No.: 850,649

[22] Filed: Mar. 13, 1992

Related U.S. Application Data

[60] Division of Ser. No. 814,226, Dec. 23, 1991, which is a continuation of Ser. No. 697,742, May 6, 1991, abandoned, which is a continuation of Ser. No. 577,834, Sep. 4, 1990, abandoned, which is a continuation of Ser. No. 376,098, Jul. 6, 1989, abandoned.

[30] Foreign Application Priority Data

Jul. 8, 1988 [JP] Japan ..... 63-170429
Jul. 8, 1988 [JP] Japan ..... 63-170430

[51] Int. Cl.[5] ..... F23D 11/44

[52] U.S. Cl. ..... 431/236; 431/207; 431/7; 431/326

[58] Field of Search ..... 431/5, 6, 7, 170, 207, 431/216, 215, 242, 243, 278, 285, 287, 347, 350, 353, 236, 237, 326; 60/722, 723, 736, 737, 753, 303, 39.511, 39.512, 39.52; 110/210, 211

[56] References Cited

U.S. PATENT DOCUMENTS 2,976,853 3/1961 Hunter et al. ..... 122/40
3,404,965 10/1968 Shiller ..... 60/902
3,509,834 5/1970 Rosenberg et al. ..... 110/212 X
3,563,031 2/1971 Topoozian ..... 600/39.512
3,607,133 9/1971 Hirao ..... 60/902 X
3,718,440 2/1973 Foster-Pegg ..... 110/212 X
3,797,231 3/1974 McLean ..... 60/39.512
3,940,923 3/1976 Pfefferle ..... 431/7 X
4,089,088 5/1978 Konczalski .
4,126,419 11/1978 Katabuchi et al. .

FOREIGN PATENT DOCUMENTS 4520046 10/1966 Japan ..... 60/303
0023706 2/1982 Japan ..... 431/170
57-23706A 5/1982 Japan .
2027609A 2/1980 United Kingdom .

*Primary Examiner*—Carl D. Price
*Attorney, Agent, or Firm*—Armstrong, Westerman, Hattori, McLeland & Naughton

[57] ABSTRACT

A combustion apparatus comprises: a large-diameter sleeve-like element forming an incoming passage through which an air/fuel mixture gas flows in a predetermined direction; at least one small-diameter sleeve-like element disposed in the incoming passage, which small-diameter sleeve-like element forms an outgoing passage through which a combustion gas having been issued from the incoming passage flows in a direction counter to the above predetermined direction; an air/fuel mixing unit for issuing the air/fuel mixture gas under a predetermined pressure to a main incoming port located in an upstream side of the incoming passage; an auxiliary incoming unit for issuing a combustion gas produced by a pilot burner to the upstream side of the incoming passage prior to supplying the air/fuel mixture gas to the incoming passage; and a combustion-gas outlet port for discharging the combustion gas having passed through the outgoing passage, which combustion-gas outlet port communicates with an outlet opening of the outgoing passage.

5 Claims, 5 Drawing Sheets

COMBUSTION APPARATUS

This is a division, of application Ser. No. 814,226 filed Dec. 23, 1991, which is a continuation of application Ser. No. 697,742 filed May 6, 1991, now abandoned, which in turn is a continuation of application Ser. No. 577,834 filed Sep. 4, 1990, now abandoned, which in turn is a continuation of application Ser. No. 376,098 filed Jul. 6, 1989, now abandoned.

BACKGROUND OF THE INVENTION

1. Field of the Invention

The present invention relates to a combustion apparatus for supplying a high-temperature combustion gas to a suitable machine or plant, for example such as gas turbines, heating furnaces, boilers and the like, and more particularly to a combustion apparatus for supplying a high-temperature combustion gas to multistage combustion-gas utilization systems connected to each other in series, in which combustion apparatus an air/fuel mixture gas is brought into contact with a number of high-temperature heating surfaces to attain a complete combustion thereof so as to produce the high-temperature combustion gas which is substantially free from oxygen.

2. Description of the Prior Art

The combustion gas produced in this type of combustion apparatus is preferably produced through a complete combustion so as to be free from any of pollutants such as nitrogen oxides ($NO_x$), unburned hydrocarbons and carbon monoxide, and to be sufficiently low in its residual oxygen content.

Heretofore, in this type of combustion apparatus, the following three combustion apparatuses have been proposed:

(1) A combustion apparatus in which: fuel is mixed with air to prepare an air/fuel mixture gas an air/fuel ratio of which is within a flammable limit range; an electric spark from an igniter plug of the apparatus initiates combustion of the mixture gas; and thereby the air/fuel mixture gas is continuously burned;

(2) A combustion apparatus disclosed in Japanese Patent Laid-Open No. 62-33213 filed by inventors of the present invention, in which combustion apparatus: fuel is mixed with a preheated air to prepare a preheated air/fuel mixture gas which reacts with catalysts to attain its catalytic combustion; and (3) A combustion apparatus disclosed in Japanese Patent Laid-Open No. 62-116808 filed by the inventors of the present invention, in which combustion apparatus: an outer peripheral surface of a heating tube of a main combustion unit is constantly heated to temperatures of ignition points of fuels by means of an auxiliary combustion unit; and the fuels are brought into contact with the thus heated heating tube of the main combustion unit so as to be burned continuously.

Of the conventional combustion apparatuses described in the above items (1) to (3):

The combustion apparatus described in the item (1) suffers from the fact that the combustion gas is partially kept at a high temperature in order to keep the flame alight, which high temperature makes it impossible to prevent nitrogen oxides ($NO_x$) from occurring in the combustion gas. In this combustion apparatus, since the time taken for fuel to mix with air is very short and the time taken for the thus prepared air/fuel mixture gas to be burned is also very short, the combustion gas produced in the combustion apparatus of the item (1) suffers from pollutants such as unburned hydrocarbons and the like together with a considerable amount of residual oxygen therein;

The combustion apparatus described in the item (2) enables the air/fuel mixture gas to burst into flame at a relatively low temperature. However, when the mixture gas is burned at a temperature of more than 1300° C., such high-temperature combustion of the mixture gas shortens the service life of the catalysts employed in the combustion apparatus, which makes it impossible to operate the combustion apparatus over an extended period of time. In addition, in this combustion apparatus, it is impossible to use sulfur-containing fuels because the sulfur has poisoning effects on the catalysts: and The combustion apparatus described in the item (3) suffers from the fact that the auxiliary combustion unit is also constantly kept in operation together with the main combustion unit, which disturbs the operator of the apparatus in control of both units. In addition, in this combustion apparatus, it is not possible to substantially completely prevent nitrogen oxides ($NO_x$) from occurring in the combustion gas.

In an air/fuel mixing unit employed in this type of combustion apparatus, an oxygen-containing gas such as air is mixed with fuel at a predetermined ratio to prepare an air/fuel mixture gas which is supplied under a predetermined pressure to the combustion unit of the apparatus. The air/fuel mixing unit is provided with a venturi tube having a venturi throat portion in which a fuel discharge nozzle is provided. As a preheated air flows through the throat portion of the venturi tube of the air/fuel mixing unit, a partial vacuum is produced at the venturi throat portion. This vacuum then causes the fuel discharge nozzle to deliver a spray of fuel into the passing preheated air stream in the venturi throat portion.

In the above combustion apparatus, in case that the combustion is conducted at a temperature of from 1200° to 1400° C., the fuel is mixed with the oxygen-containing preheated gas or air in the air/fuel mixing unit, which air has been preheated to a temperature of from 500° to 900° C. In this case, the fuel discharge nozzle provided in the throat portion of the venturi tube is also heated to a temperature of from 500° to 900° C. together with a fuel feed pipe connected with the fuel discharge nozzle. As a result, the fuel is often pyrolyzed or thermally decomposed to precipitate carbon particles in the fuel discharge nozzle and the fuel feed pipe. The thus precipitated carbon particles often clog these nozzle and pipe.

Particularly, in case that the combustion apparatus for supplying a high-temperature combustion gas (the temperature of which is about 1400° C.) to each of a plurality of boilers connected to each other in series is provided in a front portion of each of the boilers: the combustion gas discharged from the first one of the combustion apparatuses is supplied to the first one of the boilers; the combustion gas having passed through such first boiler is then supplied to the second one of the combustion apparatuses; the combustion gas having passed through such second combustion apparatus is supplied to the second one of the boilers; and operations similar to the above are sequentially conducted through the remaining boilers and combustion apparatuses until the combustion gas passes through the last one of the boilers; whereby multistage utilization of the combustion gas is realized. In this case, the combustion gas is supplied at a temperature of about 1400° C. to each of the boilers, while discharged at a temperature of about 700° C. from each of the boilers after it passes through each of the boilers. The thus discharged combustion gas is supplied to an air/fuel mixing unit of a subsequent combustion apparatus so as to be mixed with fuel and burned to be heated again to a temperature of about 1400° C. At this time, since the venturi tube of the air/fuel mixing unit has been heated to a considerably high temperature in a portion in the vicinity of the fuel discharge nozzle, the fuel in the nozzle is often pyrolyzed or thermally decomposed to precipitate carbon particles which disadvantageously clog the fuel discharge nozzle in the venturi tube of the air/fuel mixing unit.

SUMMARY OF THE INVENTION

The present invention is made under such circumstances.

Consequently, it is an object of the present invention to provide a combustion apparatus which may produce a combustion gas substantially completely free from any of pollutants such as nitrogen oxides ($NO_x$), unburned hydrocarbons, carbon monoxide and the like.

It is another object of the present invention to provide a combustion apparatus which may attain a complete combustion of a mixture gas consisting of an oxygen-containing gas or air and fuel, the mixture gas being brought into contact with a large number of high-temperature surfaces, and the combustion apparatus being provided in multistage combustion-gas utilization systems connected to each other in series so as to effectively use the combustion gas, whereby a considerable energy saving is accomplished.

It is further another object of the present invention to provide an air/fuel mixing unit for the combustion apparatus, which mixing unit is substantially free from a fear that a fuel discharge nozzle and a fuel feed pipe connected to the fuel discharge nozzle of the mixing unit are clogged with carbon particles produced through pyrolysis or thermal decomposition of the fuel supplied to the nozzle and the pipe.

According to a first embodiment of the present invention, the above objects of the present invention are accomplished by providing:

A combustion apparatus comprising:

(a) an incoming passage means for flowing a combustion gas in a predetermined direction, the incoming passage means being defined by heat insulating material, disposed in a substantially central portion of an outer casing and closed at its one end portion located in an upstream side of a stream of the combustion gas;

(b) an outgoing passage means for flowing, in a direction counter to the predetermined direction, the combustion gas having passed through the incoming passage means, the outgoing passage means being open at its opposite end portions and disposed in the incoming passage means so as to communicate with the incoming passage means at its one end portion located in a downstream side of the incoming passage means;

(c) a mixture gas main incoming means for supplying a mixture gas consisting of an oxygen-containing gas and fuel, the mixture gas main incoming means being in communication with an end portion of the incoming passage means;

(d) an oxygen-containing gas/fuel mixing unit for mixing a preheated oxygen-containing gas with fuel at a predetermined ratio to prepare the mixture gas, the oxygen-containing gas/fuel mixing unit being connected to the mixture gas main incoming means to supply the mixture gas to the mixture gas main incoming means under a predetermined pressure;

(e) a combustion-gas auxiliary incoming means for supplying another combustion gas to the incoming passage means, the another combustion gas being produced by burning fuel with an oxygen-containing gas through a pilot burner, the combustion-gas auxiliary incoming means being connected to an end portion of the incoming passage means so as to be in communication with the same at a position oppositely disposed diametrically from a position of the mixture gas main incoming means; and (f) a combustion-gas outlet means defined in side portions of the outer casing and the heat-insulating material so as to be connected to a downstream side outlet portion of the outgoing passage means;

whereby a downstream side outlet portion of the incoming passage means is in communication with an inlet portion of the outgoing passage means through a space defined in the other end portion of the incoming passage means.

According to a second embodiment of the present invention, the above objects of the present invention are accomplished by providing:

The combustion apparatus having the above construction of the first embodiment of the present invention, wherein:

a honeycomb passage member is provided in each of the outlet portions of the incoming passage means and the outgoing passage means.

According to a third embodiment of the present invention, the above objects of the present invention are accomplished by providing:

The combustion apparatus having the above construction of the first embodiment of the present invention, wherein:

both of the incoming passage means and the outgoing passage means are constructed of sleeve elements, provided that the sleeve element constituting the outgoing passage means is smaller in diameter than the sleeve element constituting the incoming passage means while concentrically disposed in the incoming passage means.

According to a fourth embodiment of the present invention, the above objects of the present invention are accomplished by providing:

The combustion apparatus having the above construction of the first embodiment of the present invention, wherein:

both of the incoming passage means and the outgoing passage means are constructed of sleeve elements, provided that a plurality of the sleeve elements constitute the outgoing passage means, each of which sleeve elements constituting the outgoing passage means is smaller in diameter than the sleeve element constituting the incoming passage means while disposed in the incoming passage means.

According to a fifth embodiment of the present invention, the above objects of the present invention are accomplished by providing:

The combustion apparatus having the above construction of the fourth embodiment of the present invention, wherein:

at least one baffle plate member is so disposed in the incoming passage means as to extend in a direction perpendicular to a longitudinal direction of the incoming passage means.

According to a sixth embodiment of the present invention, the above objects of the present invention are accomplished by providing:

The combustion apparatus having the above construction of the first embodiment of the present invention, wherein:

the oxygen-containing gas/fuel mixing unit comprises:

a venturi tube, provided with a venturi throat portion and surrounded by a heat-insulating material;

a fuel feed pipe having its fuel discharge nozzle opened into the venturi throat portion of the venturi pipe, the fuel discharge nozzle being provided in a front-end portion of the fuel feed pipe; and a cooling unit for cooling suitable portions of the fuel discharge nozzle and the fuel feed pipe communicating with the fuel discharge nozzle.

According to a seventh embodiment of the present invention, the above objects of the present invention are accomplished by providing:

A combustion apparatus comprising:

(a) a sleeve-like casing, having a circular cross section and surrounded by a heat-insulating material;

(b) a cylindrical combustion-gas passage member provided with a plurality of combustion-gas passages for providing a plurality of honeycomb-like passage wall surfaces, which plurality of combustion-gas passages are so formed as to be adjacent to each other, so as to assume a honeycomb-like cross section as a whole, through which passage member a combustion gas flows axially, the cylindrical combustion-gas passage-member being rotatably mounted in the sleeve-like casing so as to be rotated on a supporting shaft which is mounted in the sleeve-like casing, an axis of the supporting shaft being aligned with an axis of the sleeve-like casing;

(c) a pair of chambers, one of which serves as an inlet and an outlet chamber of an oxygen-containing gas/fuel mixture gas and the other of which serves as an outlet chamber of the combustion gas, the pair of chambers being so formed in an axial end portion of the sleeve-like casing as to be oppositely disposed from an axial end portion of the cylindrical combustion-gas passage member, the pair of chambers being adjacent to each other through a partition wall extending in a diametrical direction of the sleeve-like casing, the partition wall being integrally formed with the sleeve-like casing;

(d) a combustion-gas chamber so formed in the other axial end portion of the sleeve-like casing as to be oppositely disposed from the other axial end portion of the cylindrical combustion-gas passage member;

(e) a mixture-gas inlet means provided with a mixture gas inlet port which opens into one of side portions the inlet chamber of the mixture gas;

(f) an auxiliary incoming means provided with a pilot burner, the auxiliary incoming means being provided with an auxiliary incoming port of the mixture gas, which auxiliary incoming port opens into the other side portion of the inlet chamber of the mixture gas at a position spaced apart from the mixture gas inlet means; and (g) a driving unit for rotatably driving an outlet means of the combustion gas and the cylindrical combustion-gas passage member, the driving unit being connected to the supporting shaft of the cylindrical combustion-gas passage member, the outlet means of the combustion gas being provided with a combustion-gas outlet port in its one end portion, which combustion-gas outlet port opens into one side portion of the outlet chamber of the combustion gas.

According to a eighth embodiment of the present invention, the above objects of the present invention are accomplished by providing:

The combustion apparatus having the above construction of the seventh embodiment of the present invention, wherein the combustion apparatus further comprises an oxygen-containing gas/fuel mixing unit which is provided with:

a venturi tube, provided with a venturi throat portion and surrounded by a heat-insulating material;

a fuel feed pipe having its fuel discharge nozzle opened into the venturi throat portion of the venturi pipe, the fuel discharge nozzle being provided in a front-end portion of the fuel feed pipe; and a cooling unit for cooling suitable portions of the fuel discharge nozzle and the fuel feed pipe communicating with the fuel discharge nozzle.

According to a ninth embodiment of the present invention, the above objects of the present invention are accomplished by providing:

The combustion apparatus having the above construction of the seventh embodiment of the present invention, wherein:

the honeycomb-like passage wall surfaces of the cylindrical combustion-gas passage member are coated with catalysts to attain a catalytic combustion of the oxygen-containing gas/fuel mixture gas.

Additional objects, embodiments and advantages of the present invention will become apparent to anyone skilled in the art from the following detailed description of the preferred embodiments of the present invention, which will be made with reference to the accompanying drawings.

DESCRIPTION OF THE PREFERRED EMBODIMENTS

Now, preferred embodiments of a combustion apparatus of the present invention and those of an oxygen-containing gas/fuel mixing unit employed in the combustion apparatus will be described in detail with reference to the accompanying drawings.

Figure 1:
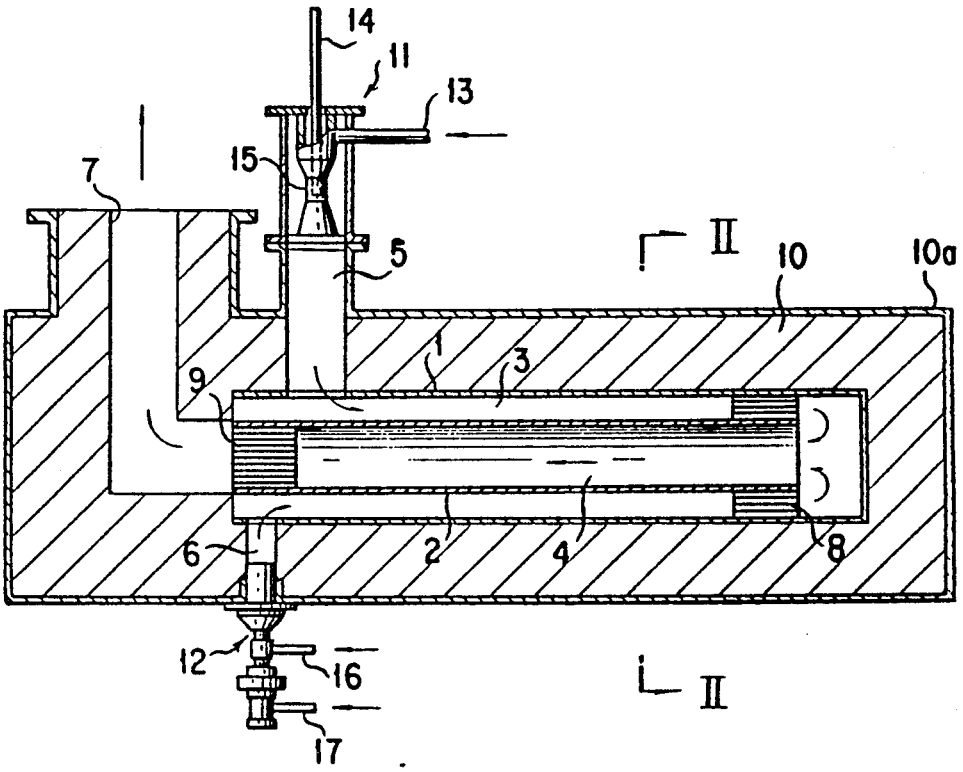
FIG. 1 is a longitudinal sectional view of a first embodiment of the combustion apparatus of the present invention.
Figure 2:
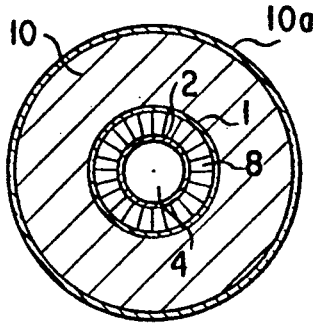
FIG. 2 is a cross-sectional view of the first embodiment of the combustion apparatus of the present invention, taken along the line 11—11 of FIG. 1.

First of all, FIGS. 1 and 2 show a first embodiment of the combustion apparatus of the present invention, in which: the reference numeral 1 denotes an outer sleeve; and 2 an inner sleeve concentrically disposed in the outer sleeve 1. Both of the outer sleeve 1 and the inner sleeve 2 are made of ceramic materials. As shown in FIG. 1, an annular incoming passage 3 of an oxygen-containing gas/fuel mixture gas is defined between an inner peripheral surface of the outer sleeve 1 and an outer peripheral surface of the inner sleeve 2, while the interior portion of the inner sleeve 2 forms an outgoing passage 4 of a combustion gas. The incoming passage 3 is closed at its end portion located in an upstream side of a stream of the mixture gas, while opened at its the other end portion into a space located in a downstream side of the stream of the mixture gas, the space being formed in an end portion of the outer sleeve 1 so as to communicate with an inlet opening of the outgoing passage 4. Consequently, the incoming passage 3 communicates with the outgoing passage 4 through such space. A main incoming port 5 opens into a peripheral wall of the incoming passage 3 at a position in the vicinity of its end portion located in the upstream side of the mixture gas. On the other hand, an auxiliary incoming port 6 also opens into the peripheral wall of the incoming passage 3 at a position circumferentially spaced apart from that of the main incoming opening 5. An outlet opening of the outgoing passage 4 opens into a combustion-gas output port 7. In the downstream side end portion of the incoming passage 3 is fixedly mounted an annular honeycomb passage member 8 made of ceramic materials. On the other hand, in the outlet opening of the outgoing passage 4 is fixedly mounted a plug-shaped honeycomb passage member 9 made of ceramic materials. These honeycomb passage members 8, 9 increase the number of passage surfaces brought into contact with the combustion gas.

As shown in FIG. 1, the outer sleeve 1 is fixedly mounted in an outer casing 10*a* through a heat-insulating material 10.

An oxygen-containing gas/fuel mixing unit 11 is connected to the main incoming port 5 in an upstream side of the incoming passage 3. On the other hand, a pilot burner 12 is connected to the auxiliary incoming port 6 in the upstream side of the incoming passage 3. To the mixing unit 11 are connected: a preheated oxygen-containing gas inlet pipe or preheated air inlet pipe 13; and a fuel feed pipe 14. Fuel supplied from the fuel feed pipe 14 is mixed with a preheated oxygen-containing gas (hereinafter simply referred as the preheated air) supplied from the preheated air inlet pipe 13 at a predetermined ratio in an air/fuel mixing portion 15 of the mixing unit 11 to prepare an air/fuel mixture gas which is supplied to an upstream side of the incoming passage 3. To the pilot burner 12 are connected: an air inlet pipe 16; and a fuel feed pipe 17. A combustion gas issued from the pilot burner 12 is supplied to an upstream side of the incoming passage 3 through the auxiliary incoming port 6.

In operation of the first embodiment of the combustion apparatus of the present invention having the above construction, first of all, the pilot burner 12 is operated to issue the combustion gas to the upstream side of the incoming passage 3 so that the combustion gas heats both the outer sleeve 1 and the inner sleeve 2 in the upstream side of the incoming passage 3. After both the outer sleeve 1 and the inner sleeve 1 are heated to predetermined temperatures of more than about 900° C. in the upstream side of the incoming passage 3, the mixing unit 11 is operated to issue an oxygen-containing gas/fuel mixture gas, i.e., an air/fuel mixture gas to the upstream side of the incoming passage 3 through the main incoming port 5. At this time, operation of the pilot burner 12 is immediately, or gradually stopped so as to cooperate with that of the mixing unit 12 for a while.

Under such circumstances, the thus issued air/fuel mixture gas enters the incoming passage 3 through the main incoming port 5, and is brought into contact with both of the inner peripheral surface of the outer sleeve 1 and the outer peripheral surface of the inner sleeve 2, which peripheral surfaces have been heated to sufficiently high temperatures, so that the mixture gas bursts into flame to produce a combustion gas. The thus produce combustion gas passes through the incoming passage 3 to enter the outgoing passage 4, and is then discharged from the combustion-gas outlet port 7. Consequently, the combustion gas heats the outer and inner peripheral surface of the incoming passage 3 and the inner peripheral surface of the outgoing passage 4 sequentially, to make it possible to attain a complete combustion of the mixture gas which is issued from the mixing unit 11 to the incoming passage 3. As described above, the fuel supplied to the mixing unit 11 is so mixed with the preheated air in the mixing unit 11 as to constantly keep the combustion gas at a predetermined temperature of from 1200° to 1400° C.

In the above operation, the combustion initiated at the upstream side of the incoming passage 3 propagates to the downstream side of the incoming passage 3, and further propagates to the outlet opening of the outgoing passage 4 therethrough. Consequently, the inner sleeve 2 interposed between the incoming passage 3 and the outgoing passage 4 is heated by the combustion gas in its inner and outer peripheral surface. The honeycomb passage members 8 and 9, which are mounted in the downstream side end portion of the incoming passage 3 and the outlet opening of the outgoing passage 9 respectively, further ensure the mixture gas a complete combustion. In addition, in case that the inner peripheral surface of the outer sleeve 1 is coated with a suitable material excellent in infrared-absorption properties, it is possible to further increase the temperature of the inner peripheral surface of the outer sleeve 1 because infrared radiation from the outer peripheral surface of the inner sleeve 2 is effectively received by the inner peripheral surface of the outer sleeve 1 so as to increase the temperature of the inner peripheral surface of the outer sleeve 1. The thus coated inner surface of the outer sleeve 1 may serve as an effective heating surface for enhancing the combustion of the mixture gas.

Figure 3:
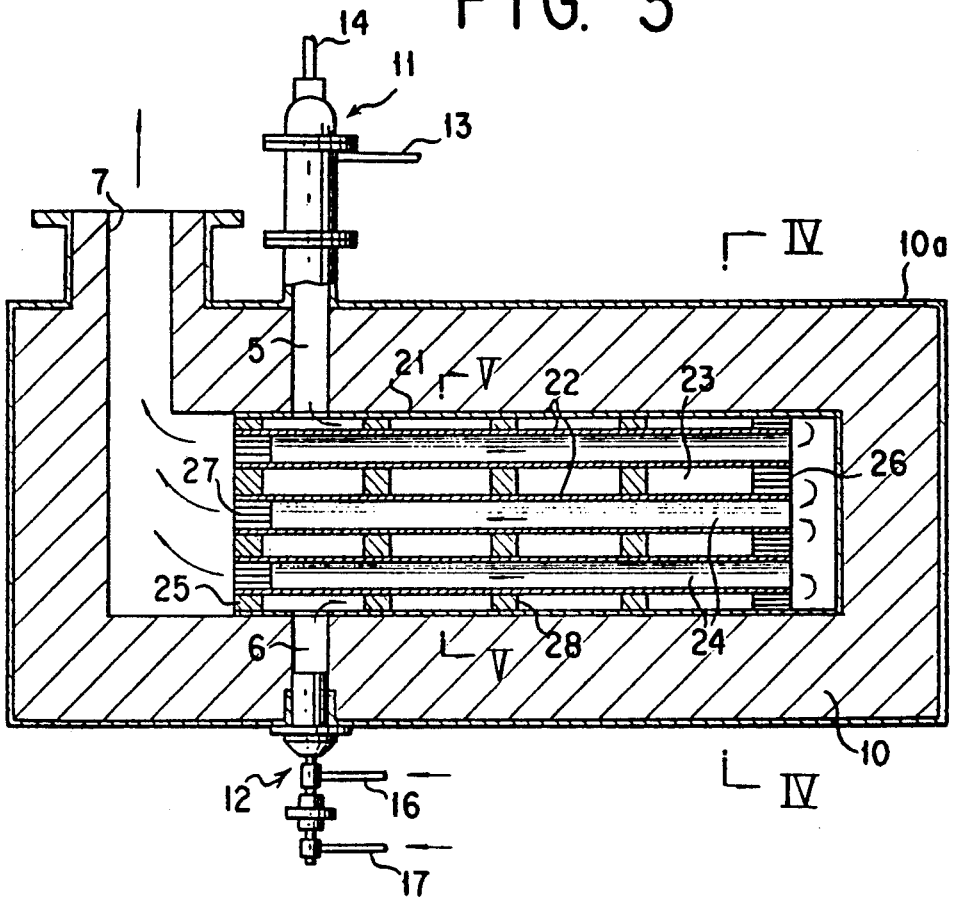
FIG. 3 is a longitudinal sectional view of a second embodiment of the combustion apparatus of the present invention.
Figure 4:
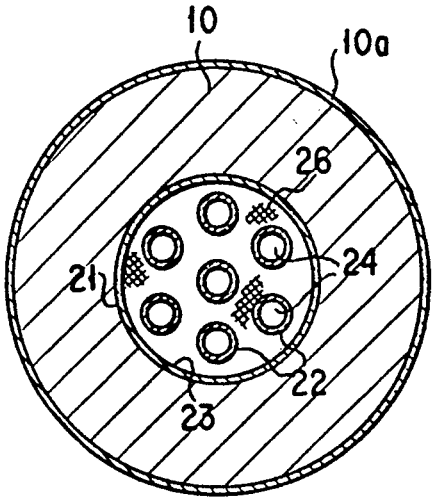
FIG. 4 is a cross-sectional view of the second embodiment of the combustion apparatus of the present invention, take along the line 1V—1V of FIG. 3.
Figure 5:
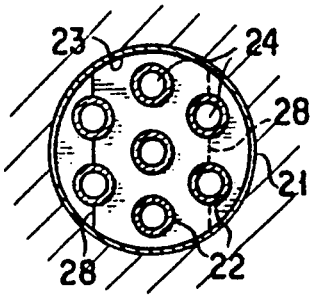
FIG. 5 is a cross-sectional view of the second embodiment of the combustion apparatus of the present invention, take along the line V—V of FIG. 3.

FIGS. 3 to 5 show a second embodiment of the combustion apparatus of the present invention. In the second embodiment of the present invention, the components which are the same as ones in the first embodiment of the present invention shown in FIGS. 1 and 2 have been given the same reference numerals, and therefore are not further explained hereinbelow.

As shown in FIG. 3, in the second embodiment of the combustion apparatus of the present invention, a plurality of inner sleeves 22 made of ceramic materials are fixedly mounted in the outer sleeve 21 made of ceramic materials so that the incoming passage 23 is defined between the inner peripheral surface of the outer sleeve 21 and the outer peripheral surfaces of the inner sleeves 22. On the other hand, the interior portion of each of the inner sleeves 22 forms the outgoing passage 24. An upstream side end of the incoming passage 23 is closed with a supporting wall member 25 which supports each of the outlet opening portions of the inner sleeves 22. Honeycomb passage members 26 and 27 are fixedly mounted in the downstream side portion of the incoming passage 23 and the outlet opening portions of the outgoing passages 24, respectively. In addition, in the incoming passage 23, there are also fixedly mounted at least one baffle plate member 28 the number of which is three in the second embodiment of the combustion apparatus of the present invention, as shown in FIG. 3.

The second embodiment of the combustion apparatus of the present invention shown in FIGS. 3 fo 5 is the substantially same in operation as the first embodiment of the combustion apparatus of the present invention shown in FIGS. 1 and 2. The second embodiment of the combustion apparatus of the present invention is advantageous in producing a large quantity of the combustion gas.

Namely, in operation of the second embodiment of the combustion apparatus of the present invention shown in FIGS. 3 to 5, first of all, walls of the incoming passage 23 are heated to predetermined temperatures of about 900° C. by means of the pilot burner 12 in the upstream side of the incoming passage 23. After that, the air/fuel mixture gas produced in the mixing unit 11 is supplied to the interior of the incoming passage 23 so as to burst into flame therein to produce the combustion gas. The thus produced combustion gas passes through a labyrinth constructed of the baffle plate members 28 within the incoming passage 23, and flows to the downstream side of the incoming passage 23. Consequently, when the mixture gas passes through the incoming passage 23, it is sufficiently agitated so as to attain a complete combustion thereof. Then, the combustion gas reached the downstream side of the incoming passage 23 enters the honeycomb passage members 26. The combustion gas having passed through the honeycomb passage members 26 enters the outgoing passages 24 in which the combustion gas is brought into contact with the inner peripheral walls of the inner sleeves 22 so as to be further heated to ensure the complete combustion of the mixture gas. After that, the combustion gas enters the honeycomb passage members 27, and passes therethrough to flow into the combustion-gas outlet port 7 from which the combustion gas is discharged.

Figure 6:
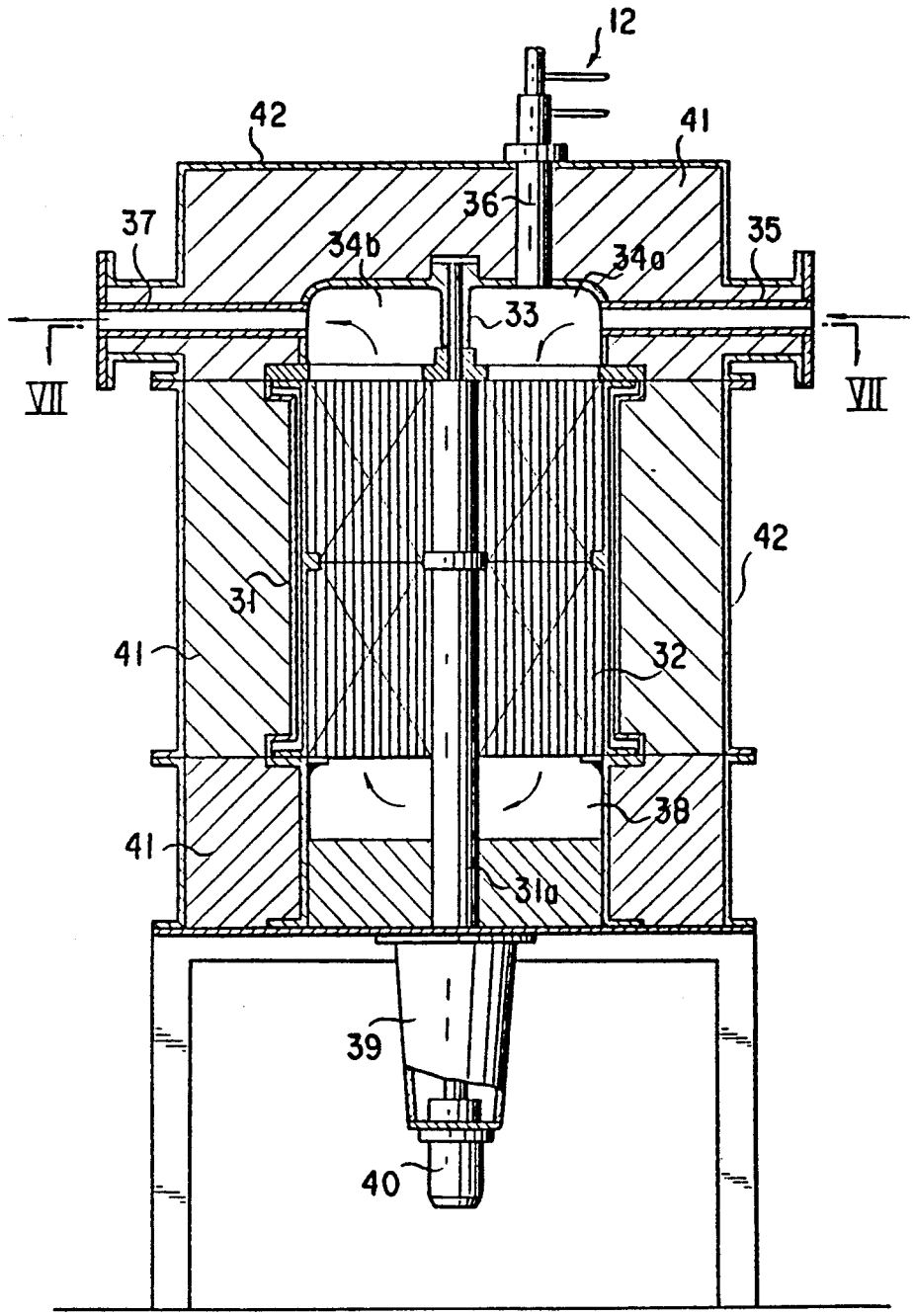
FIG. 6 is a longitudinal sectional view of a third embodiment of the combustion apparatus of the present invention.
Figure 7:
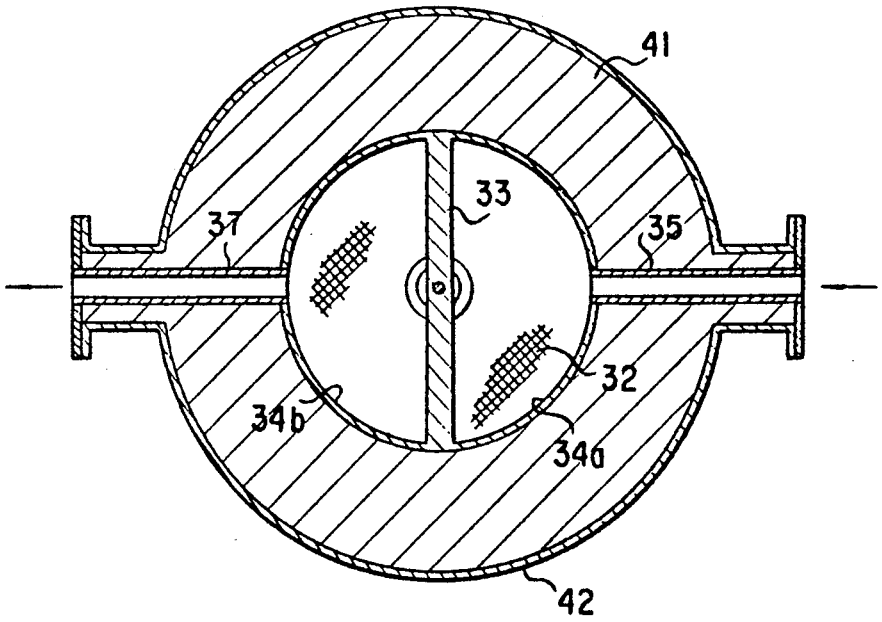
FIG. 7 is a cross-sectional view of the third embodiment of the combustion apparatus of the present invention, take along the line V11—V11 of FIG. 6.

FIGS. 6 and 7 show a third embodiment of the combustion apparatus of the present invention, in which: the reference numeral 41 denotes a heat-insulating material; and 31 a sleeve-like casing made of ceramic material, which sleeve-like casing 31 has a circular cross section and extends vertically. In the sleeve-like casing 31 is concentrically and rotatably mounted an annular honeycomb passage member 32 which is made of ceramic materials while rotatably supported on a supporting shaft 31*a* an axis of which is aligned with that of the sleeve-like casing 31. In an upper portion of the sleeve-like casing 31 are provided a pair of chambers 34*a*, 34*b* which are oppositely disposed from an upper-end surface of the honeycomb passage member 32. These chambers 34*a*, 34*b* are adjacent to each other through a partition wall 33 which is so integrally formed with the sleeve-like casing 31 as to extend in a diametrical direction of the casing 31. One 34*a* of the chamber 34*a*, 34*b* serves as an air/fuel mixture gas inlet chamber 34*a*, while the other 34*b* serves as a combustion-gas outlet chamber 34*b*. An air/fuel mixture gas inlet port 35 opens into a side portion of the mixture gas inlet chamber 34*a*. On the other hand, a combustion-gas outlet port 37 opens into the a side portion of the combustion-gas outlet chamber 34*b*. In a lower portion of the sleeve-like casing 31 is formed a combustion-gas chamber 38 which is oppositely disposed from a lower-end surface of the honeycomb passage member 32.

A lower-end portion of the supporting shaft 31*a* of the honeycomb passage member 32 is rotatably mounted in a supporting frame 39, while connected to a suitable driving unit 40 for rotatably driving the supporting shaft 31*a*. In the honeycomb passage member 32, there are provided a plurality of fine passages which extend in parallel with the axis of the honeycomb passage member 32 over the whole axial length of the passage member 32 and are adjacent to each other. An upper-end portion of each of the above fine passages of the honeycomb passage member 32 opens into the mixture gas inlet chamber 34*a* and the combustion-gas outlet chamber 34*b*, while a lower-end portion of each of such fine passages opens into the combustion-gas chamber 38, as shown in FIG. 6. Namely, as the honeycomb passage member 32 rotates, the fine passages of the honeycomb passage member 32 alternately serve as the incoming passage and the outgoing passage.

As shown in FIG. 7, the pilot burner 12 provided with the auxiliary incoming port 36 is connected to the mixture gas inlet chamber 34*a* at a position oppositely disposed diametrically from that of the mixture gas inlet port 35 which also opens into the mixture gas inlet chamber 34*a*. The sleeve-like casing 31 is surrounded with a heat-insulating material 41, while fixedly mounted in an outer casing 42 through the heat-insulating material 41.

In operation of the third embodiment of the combustion apparatus of the present invention having the above construction, the honeycomb passage member 32 is constantly rotated at a predetermined rotational speed. Under such circumstances, first of all, the pilot burner 12 is operated to issue a combustion gas to the mixture gas inlet chamber 34*a* through the auxiliary incoming port 36, so that both of the mixture gas inlet chamber 34*a* and the upper-end portion of the honeycomb passage member 32 are heated together by the combustion gas. During such heating, since the honeycomb passage member 32 is rotated constantly, the whole area of the upper-end portion of the honeycomb passage member 32 is sequentially heated to a predetermined temperature of about 900° C. When the temperature of the upper-end portion of the honeycomb passage member 32 reaches about 900° C., operation of the pilot burner 12 is stopped to stop the heating of the honeycomb passage member 32, while a preheated air/fuel mixture gas is supplied to the mixture gas inlet chamber 34*a* through the mixture gas inlet port 35. The thus supplied mixture gas is then brought into contact with a preheated wall surface of the chamber 34*a* to burst into flame, and flows downward through a part of the honeycomb passage member 32 serving as the incoming passage so that the combustion of the mixture gas conducted in the incoming passage is completed when the gas reaches the combustion-gas chamber 38. The combustion gas entered the combustion-gas chamber 38 then flows into the other part of the honeycomb passage member 32 serving as the outgoing passage which is partially constructed of the fine passages of honeycomb passage member 32 located in a position corresponding to that of the combustion-gas outlet chamber 34*b*. Combustion of the mixture gas continues in the outgoing passage so that the combustion gas reaches the combustion-gas outlet chamber 34*b* from which the combustion gas is discharged through the combustion-gas outlet port 37. At this time, the outgoing passage (32) oppositely disposed from the combustion-gas outlet chamber 34*b* is heated by the combustion gas issued from the combustion-gas chamber 38. As the honeycomb passage member 32 rotates, the thus heated outgoing passage or some of the fine passages of the honeycomb passage member 32 is sequentially transferred to a position oppositely disposed from the mixture gas inlet chamber 34*a* so as to serve as the incoming passage. Consequently, since the thus sequentially transferred outgoing passage has been sufficiently heated by the combustion gas and serves as the incoming passage, the mixture gas entered the thus heated incoming passage is brought into contact with the sufficiently heated wall surfaces of the incoming passage constructed of the honeycomb passage member 32, to enable the mixture gas to continuously burst into flame.

The third embodiment of the combustion apparatus of the present invention shown in FIGS. 6 and 7 may be modified to form a fourth embodiment of the combustion apparatus of the present invention in which each of the wall surfaces of the fine passages of the honeycomb passage member 32 are coated with catalysts to attain a catalytic combustion of the mixture gas. The catalysts employed in the present invention comprise platinum, palladium and the like. Coating of the wall surfaces of the honeycomb passage member 32 with the catalysts is conducted by dipping the honeycomb passage member 32 in solutions of the catalysts.

The above fourth embodiment of the combustion apparatus of the present invention enables the mixture gas supplied from the mixture gas inlet port 35 to burst into flame to attain a catalytic combustion thereof even when the temperatures of the wall surfaces of the upstream side of the incoming passage are less than 900° C., which wall surfaces are heated by the combustion gas which is produced by the pilot burner 12 and issued from the auxiliary incoming port 36.

Namely, in the fourth embodiment of the combustion apparatus of the present invention, the fuel is mixed with a preheated air to prepare the mixture gas. In case that a gaseous fuel is employed, it is possible to eliminate the preheating operation of the air. In case that a liquid fuel is employed, it is possible to extremely lower the temperature of the preheated air, provided that the temperature of the fuel in the air is slightly higher than dew point.

Incidentally, in the above fourth embodiment of the combustion apparatus of the present invention, sulfur-containing fuels can not be employed because sulfur has poisoning effects on the catalysts employed in the above fourth embodiment.

In each of the above embodiments of the combustion apparatus of the present invention, the ceramic materials constituting each of the components such as the outer sleeve 1, inner sleeve 2, 22, sleeve-like casing 31 and the honeycomb passage member 8, 9, 26, 27, 32 may be silicon carbide which is excellent in mechanical strength, heat-resisting properties and thermal shock resistance. However, it is also possible that these components are made of any other suitable ceramic materials such as zirconia-base ceramics and cordierite-base ceramics.

In addition, each of the outer sleeve 1, 21 and the sleeve-like casing 31 may be made of alumina-fiber ceramics. In this case, it is preferable to firmly coat, by a suitable applying process such as spraying and the like, the inner surfaces of the outer sleeve 1, 21 and the sleeve-like casing 31 with a paint a main component of which is a suitable oxide such as $SiZrO_4$, $MnO_2.Cr_2O_3$ and the like excellent in infrared-absorption properties.

Now, two different embodiments of the oxygen-containing gas/fuel mixing unit (hereinafter referred to as the air/fuel mixing unit) employed in the combustion apparatus of the present invention having the above construction will be described in detail with reference to FIGS. 8 and 9.

Figure 8:
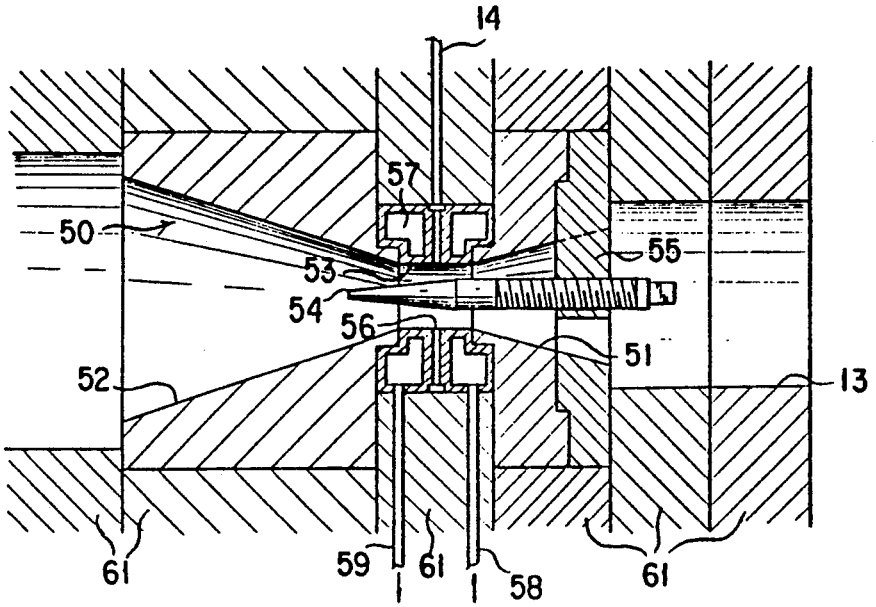
FIG. 8 is a longitudinal sectional view of a first embodiment of the oxygen-containing gas/fuel mixing unit employing in the combustion apparatus of the present invention.

In a first embodiment of the air/fuel mixing unit of the present invention shown in FIG. 8: the reference numeral 50 denotes a venturi tube comprising an inlet reducer portion 51, an outlet diffuser portion 52 and a venturi throat portion 53 sandwiched between these portions 50 and 51. A performance-control rod 54 provided with a tapered front portion is threadably engaged with a supporting member 55 so as to be axially displaceable relative to the supporting member 55 which is fixedly mounted in the venturi tube 50. A preheated-air inlet pipe 13 is connected to an air-inlet opening of the venturi tube 50 an air/fuel mixture gas outlet opening of which is connected to the combustion apparatus of the present invention.

A plurality of fuel discharge openings 56 are so provided in an inner peripheral surface of the throat portion 53 of the venturi tube 50 as to be spaced apart from each other in a circumferential direction of the inner peripheral surface of the throat portion 53, to which openings 56 a fuel feed pipe 14 is connected. As is clear from FIG. 8, an annular water jacket 57 is placed around the venturi throat portion 53 to keep this portion 53 cool. To the water jacket 57 are connected: a cooling-water inlet pipe 58; and a cooling-water outlet pipe 59.

As shown in FIG. 8, in this first embodiment of the air/fuel mixing unit employed in the combustion apparatus of the present invention, an incoming gas comprising the preheated air and the oxygen-containing gas such as the combustion gas is supplied from the preheated-air inlet pipe 13 to the venturi throat portion 53 in which the incoming gas is accelerated to cause the fuel discharge openings 56 to deliver the fuel in spraying manner so that the air/fuel mixture gas is produced. The thus produced air/fuel mixture gas is then supplied to the combustion apparatus of the present invention, while agitated in the subsequent outlet diffuser portion 52 of the venturi tube 50.

In the air/fuel mixing unit described above, when the fuel is sprayed into the heated incoming gas to produce the air/fuel mixture gas, a part of the thus produced mixture gas reaches a flammable limit range. In order to prevent the air/fuel mixture from burning in the venturi tube 50, the thus produced air/fuel mixture gas must be rapidly agitated in the venturi tube 50. Consequently, in the air/fuel mixing unit employed in the present invention, it is necessary to accelerate the incoming gas to a velocity of at least 100 m/second in the venturi throat portion 53 so as to make it possible to rapidly agitate the thus produced air/fuel mixture gas.

Since the performance-control rod 54 is disposed in the axially central portion of the venturi throat portion 53, an axially central passage of the incoming gas in the venturi throat portion 53 is decreased in its cross-sectional area to keep a thickness of a stream of the incoming gas thin in the venturi throat portion 53. Consequently, even when the venturi throat portion 53 is relatively large in its cross-sectional area, it is possible to sufficiently accelerate the incoming gas and cause the resultant air/fuel mixture gas to rapidly agitated in the subsequent outlet diffuser portion 52 of the venturi tube 50.

The cross-sectional area of the venturi throat portion 53 is so controlled by axially displacing the performance-control rod 54 as to keep a flow rate of the incoming gas constant in the venturi throat portion 53 even when a quantity of the incoming gas varies, whereby it is possible to supply the air/fuel mixture gas having a constant mixing ratio to the combustion apparatus of the present invention.

In the above first embodiment of the air/fuel mixing unit shown in FIG. 8, a cooling water is supplied to the water jacket 57 to cool the venturi throat portion 53. Since the venturi throat portion 53 is adequately cooled in the above manner, the fuel discharge openings 56 and a front-end portion of the fuel feed pipe 14 connected thereto are also adequately cooled to prevent the fuel from being thermally decomposed in the fuel discharge openings 56. When the fuel is thermally decomposed to produce carbon particles, the fuel discharge openings 56 are clogged with the thus produced carbon particles. Consequently, it is possible to prevent the fuel discharge openings 56 from being clogged with the carbon particles by adequately cooling the venturi throat portion 53.

Figure 9:
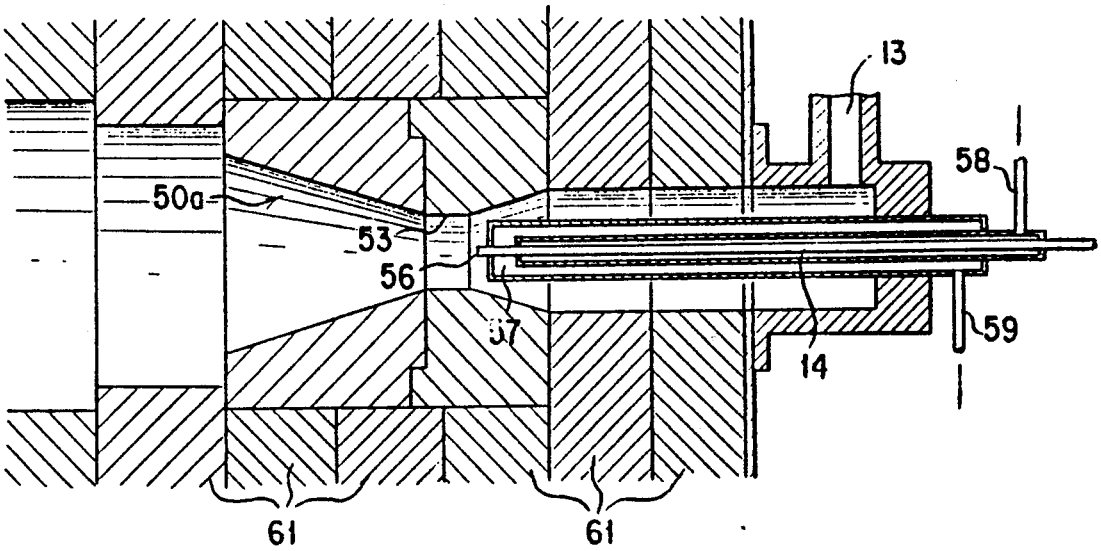
FIG. 9 is a longitudinal sectional view of a second embodiment of the oxygen-containing gas/fuel mixing unit employing in the combustion apparatus of the present invention.

FIG. 9 shows a second embodiment of the air/fuel mixing unit employed in the combustion apparatus of the present invention, which second embodiment represents a constant-performance type air/fuel mixing unit. As shown in FIG. 9, the fuel discharge nozzle 56 is so disposed in the throat portion 53 of the venturi tube 50*a* as to be oriented toward a downstream side of the venturi tube 50*a*. The fuel discharge nozzle 56 is formed in a front-end portion of the fuel feed pipe 14 around which is placed the water jacket 57 to which are connected the cooling-water inlet pipe 58 and the cooling-water outlet pipe 59.

In this second embodiment of the air/fuel mixing unit shown in FIG. 9, a cooling water is supplied to the water jacket 57 to adequately cool both the fuel discharge nozzle 56 and the fuel feed pipe 14 so that the fuel is prevented from being thermally decomposed and from producing the carbon particles in the fuel discharge nozzle 56 and the fuel feed pipe 14, whereby these components 56, 14 are prevented from being clogged with the resultant carbon particles.

Incidentally, in the first embodiment of the air/fuel mixing unit shown in FIG. 8, it is also possible to control the performance-control rod 54 automatically according to a quantity of the preheated incoming gas or air.

In FIGS. 8 and 9, the reference numeral 61 denotes a heat-insulating material.

In the above air/fuel mixing unit shown in FIGS. 8 and 9, preferably, the venturi throat portion 53 is made of a suitable heat-resisting alloy such as Inconel alloys and Hastelloy alloys, while each of the inlet reducer portion 51, outlet diffuser portion 52 and other inner components of the venturi tube 50 is made of a suitable ceramic material such as silicon carbide, zirconia, cordierite and the like.

What is claimed is:

1. A combustion apparatus comprising:

(a) a sleeve-like casing having a circular cross section and surrounded by a heat-insulating material;

(b) a cylindrical combustion-gas passage member, having a honeycomb structure, provided with a plurality of combustion-gas passages for providing a plurality of honeycomb-like passage wall surfaces, wherein said plurality of combustion-gas passages are formed so as to be adjacent to each other, so as to assume a honeycomb-like cross section as a whole, through which passage member a combustion gas flows axially, said cylindrical combustion-gas passage member being rotatably mounted in said sleeve-like casing so as to be rotated on a supporting shaft which is mounted in said sleeve-like casing, an axis of said supporting shaft being aligned with an axis of said sleeve-like casing, wherein said combustion-gas passage member, having said honeycomb structure, is made of silicon carbide, said silicon carbide being heated to about 900° C. for complete combination thereof;

(c) a pair of chambers, one of which serves as an inlet and an outlet chamber of an oxygen-containing gas/fuel mixture gas and the other of which serves as an outlet chamber of said combustion gas, said pair of chambers being so formed in a first axial end portion of said sleeve-like casing so as to be oppositely disposed from a first axial end portion of said cylindrical combustion-gas passage member, said pair of chambers being adjacent to each other through a partition wall extending in a diametrical direction of said sleeve-like casing, said partition wall being integrally formed with said sleeve-like casing;

(d) a combustion-gas chamber so formed in a second axial end portion of said sleeve-like casing so as to be oppositely disposed from a second axial end portion of said cylindrical combustion-gas passage member, said first and second axial end portions of said sleeve-like casing being directly opposite each other, and said first and second axial end portions of said cylindrical combustion-gas passage member being directly opposite each other;

(e) a mixture-gas inlet means for introducing a first mixture gas and provided with a mixture gas inlet port which opens into said inlet chamber;

(f) an auxiliary incoming means for introducing a second mixture gas and provided with a pilot burner, said auxiliary incoming means being provided with an auxiliary incoming port, wherein said second mixture gas, having fuel and air, passing through said auxiliary incoming port is different from said first mixture gas, having fuel and air, passing through said mixture gas inlet port, wherein said auxiliary incoming port opens into said inlet chamber of said mixture gas at a position spaced apart from said mixture gas inlet means; and (g) a driving unit for rotatably driving an outlet means of said combustion gas and said cylindrical combustion-gas passage member, said driving unit being connected to said supporting shaft of said cylindrical combustion-gas passage member, said outlet means of said combustion gas being provided with a combustion-gas outlet port in an open end portion thereof, which combustion-gas outlet port opens into one side portion of said outlet chamber of said combustion gas.

2. The combustion apparatus as set forth in claim 1, wherein said combustion apparatus further comprises an oxygen-containing gas/fuel mixing unit which is provided with:

a venturi tube, provided with a venturi throat portion and surrounded by a heat-insulating material;

a fuel feed pipe having its fuel discharge nozzle opened into said venturi throat portion of said venturi pipe, said fuel discharge nozzle being provided in a front-end portion of said fuel feed pipe; and a cooling unit for cooling suitable portions of said fuel discharge nozzle and said fuel feed pipe communicating with said fuel discharge nozzle.

3. The combustion apparatus as set forth in claim 2 wherein:

said venturi tube is made of at least one of ceramic materials selected from the group consisting of silicon carbide, zirconia and cordierite.

4. The combustion apparatus as set forth in claim 1, wherein:

said honeycomb-like passage wall surfaces of said cylindrical combustion-gas passage member are coated with catalysts to attain a catalytic combustion of said mixture gas.

5. The combustion apparatus as set forth in claim 4 wherein:

said catalysts comprises platinum or palladium.

* * * * *